US006369305B2

(12) United States Patent
Powers et al.

(10) Patent No.: US 6,369,305 B2
(45) Date of Patent: Apr. 9, 2002

(54) GUITAR BRIDGE

(75) Inventors: Michael V. Powers, Meridian, MS (US); David Joshua Borisoff, Romulus, NY (US)

(73) Assignee: Peavey Electronics Corporation, Meridian, MS (US)

( * ) Notice: Subject to any disclaimer, the term of this patent is extended or adjusted under 35 U.S.C. 154(b) by 0 days.

(21) Appl. No.: 09/855,802

(22) Filed: May 16, 2001

Related U.S. Application Data

(60) Provisional application No. 60/214,803, filed on Jun. 28, 2000.

(51) Int. Cl.[7] ..... G10D 3/04

(52) U.S. Cl. ..... 84/298; 84/307; 84/299; 84/294

(58) Field of Search ..... 84/298, 299, 294, 84/307

(56) References Cited

U.S. PATENT DOCUMENTS

| | | | | | |
|---|---|---|---|---|---|
| 1,230,695 | A | * | 6/1917 | Fickert | 84/298 |
| 2,082,951 | A | * | 6/1937 | Grover | 84/298 |
| 2,292,232 | A | * | 8/1942 | Liske | 84/312 R |
| 3,896,695 | A | | 7/1975 | Kingsbury | 84/307 |
| 4,230,014 | A | | 10/1980 | Hoshino | 84/299 |
| 4,433,605 | A | | 2/1984 | Matsui | 84/299 |
| 4,807,508 | A | | 2/1989 | Yairi | 84/297 R |
| 4,840,103 | A | | 6/1989 | Mayer | 84/297 R |
| 5,477,764 | A | | 12/1995 | Carrico | 84/297 R |
| 5,644,094 | A | * | 7/1997 | Dickson, II | 84/307 |
| 5,686,677 | A | | 11/1997 | Herbert | 84/307 |
| 6,124,536 | A | | 9/2000 | Hoshino | 84/298 |

* cited by examiner

*Primary Examiner*—Shih-Yung Hsieh
(74) *Attorney, Agent, or Firm*—Dykema Gossett PLLC

(57) ABSTRACT

A guitar bridge having a body comprised of a base and a main portion with a plurality of slots formed in the main portion of the body. A plurality of holes are formed in the body and located within the plurality of slots. A resonance chamber is formed in the main portion of the body. A plurality of coupling screws secure the body of the bridge to the body of the musical instrument. Strings are threaded through the bridge and through the compression screws so that dual compression of the bridge is achieved with the use of a two-way pressure system formed by the pressure of the coupling screws and the instrument strings.

11 Claims, 3 Drawing Sheets

GUITAR BRIDGE

CROSS-REFERENCE TO RELATED APPLICATIONS

This application claims priority to a provisional patent application to Michael Powers, Ser. No. 60/214,803, filed on Jun. 28, 2000, and is currently pending.

BACKGROUND OF THE INVENTION

This invention relates generally to a mechanism for attaching strings to a musical instrument such as a guitar and more particularly to a bridge for attaching such strings to a musical instrument where the bridge is connected to the instrument through a dual compression system.

Guitar strings are attached to guitars through a variety of mechanisms, one of the most common types of mechanism being a bridge that is screwed down to the top of the instrument body. The strings pass through the back section of the bridge and pull the bridge up and away from the body. While a common use of this bridge would be in combination with a guitar, it is foreseeable that the bridge could be used with a variety of stringed instruments other than guitars.

Another type of attaching means is comprised of a combination of a guitar bridge and a bridge member, wherein the strings pass over the bridge and are attached to the guitar through a series of pins located adjacent the guitar bridge. This mechanism is illustrated in the patent issued to Yairi, U.S. Pat. No. 4,807, 508.

The patent issued to Mayer, U.S. Pat. No. 4,840,130, which is directed to a "String Lock For Acoustical Instruments" shows still a different type of attachment means. The Mayer device is for a guitar bridge having an upper and lower portion that are attached to the guitar, usually by glue. Located on the opposite side of the lower portion is a plurality of string locks. A bore extends through the upper portion, the guitar, the lower portion and the string lock. The guitar string is strung through the bore and held within a circular depression on the lower side of the lower portion. The drawback of this invention is that the strings pull the upper portion of the device away from the guitar.

A somewhat different approach to string attachment mechanism can be found in U. S. Pat. No. 5,477,764, issued to Carrico, which discloses a mechanism composed of two hollow-core attachment cylinders that fit matingly, one inside the other. The first cylinder is frictionally engaged with the guitar bridge. The string is strung through the second cylinder, which then fit within the first cylinder and locked into place. When the second cylinder is placed within the first cylinder, the string is frictionally locked in place between the first cylinder and the second cylinder.

While there are many other ways of attaching strings to the face of a musical instrument, most consist of attaching the musical instrument bridge directly to the musical instrument through screws, glue, and the like. In most of the commonly known methods, the bridge is subject to the pressures of the strings pulling the bridge forward and away from the face of the musical instrument wherein the bridge eventually separates from the musical instrument.

The present invention offsets the forces applied to the musical instrument bridge that force the bridge to separate from the musical instrument by using a dual compression system wherein pressure is applied to the opposite side of the musical instrument bridge from the strings so as to apply a force on the opposite side of the musical instrument bridge from the side that receives direct pressure from the strings themselves.

SUMMARY OF THE INVENTION

It is an object of the present invention to provide a guitar bridge that is attached to the musical instrument with a dual compression system.

The dual compression system is achieved by a guitar bridge having a body comprised of a base and a main portion with a plurality of slots formed in the main portion of the body. A plurality of holes are formed in the body and located within the plurality of slots. A resonance chamber is formed in the main portion of the body. A plurality of coupling screws secure the body of the bridge to the body of the musical instrument. Strings are threaded through the bridge and through the compression screws so that dual compression of the bridge is achieved with the use of a two-way pressure system formed by the pressure of the coupling screws and the instrument strings.

Other objects, advantages and novel features of the invention will become more apparent from the following detailed description of the invention when taken in conjunction with the accompanying drawings.

DETAILED DESCRIPTION OF THE INVENTION

Figure 1:
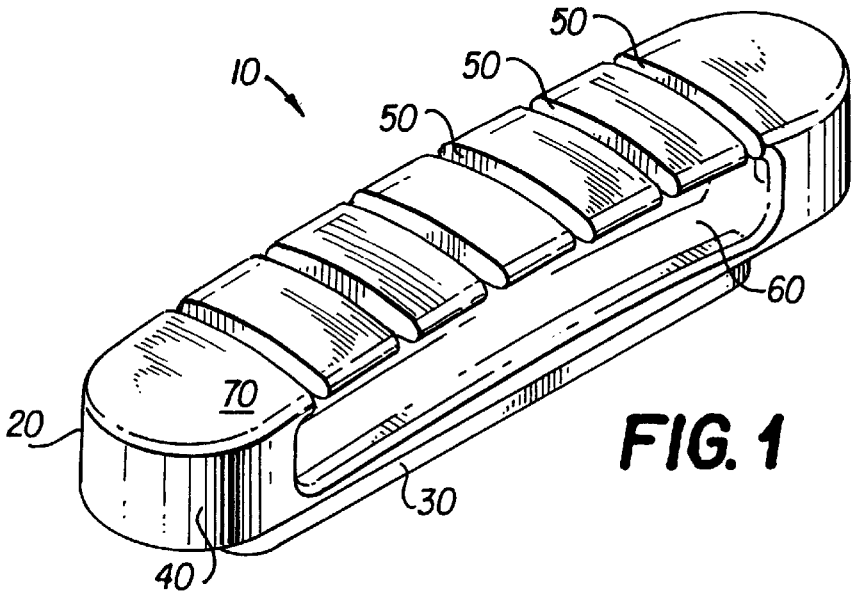
FIG. 1 is a perspective view of the guitar bridge of the present invention.
Figure 2:
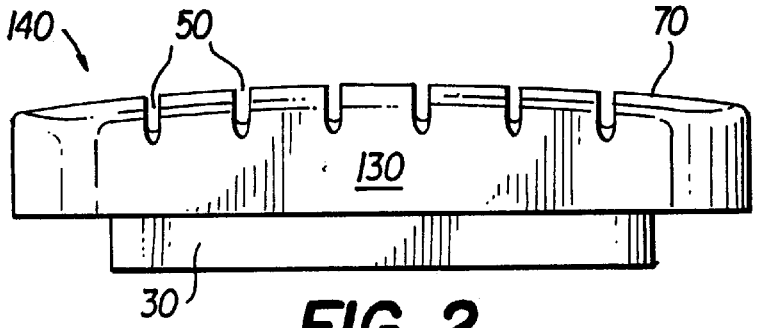
FIG. 2 is a front elevational view thereof.
Figure 3:
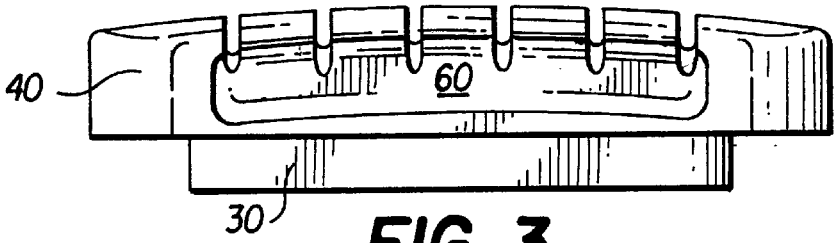
FIG. 3 is a rear elevational view thereof.

The bridge 10 of the present invention is illustrated in the figures. FIGS. 1–3 disclose the bridge 10 which has a body 20 that is comprised of a base portion 30 and a main portion 40. The body 20 is long, narrow and substantially rectangular with rounded corners.

The main portion 40 has a top surface 70, and a side wall 130 that extends around the perimeter of the body 20. The main portion 40 of the body 30 is larger than the base portion 30 and thus each end overhangs the base portion 30. The main portion 40 is integrally formed with and atop the base portion 30. Although not shown in the present embodiment, it is possible for the main portion 40 to be the same size or even slightly smaller than the base portion 30.

A resonance chamber 60 is formed in the side wall 130 on one side of the body 30, as shown in FIG. 3. The chamber 60 extends across a substantial portion of one side of the body 30 and has a hollow interior. The shape of the chamber 60 allows the bridge 10 to vibrate when in use.

The top surface 70 of has a slightly arched or curved shape 140 that extends from one end to the other end.

Figure 6:
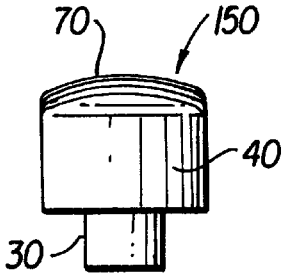
FIG. 6 is a left side elevational view thereof, the right side elevational view being the same.
Figure 8:
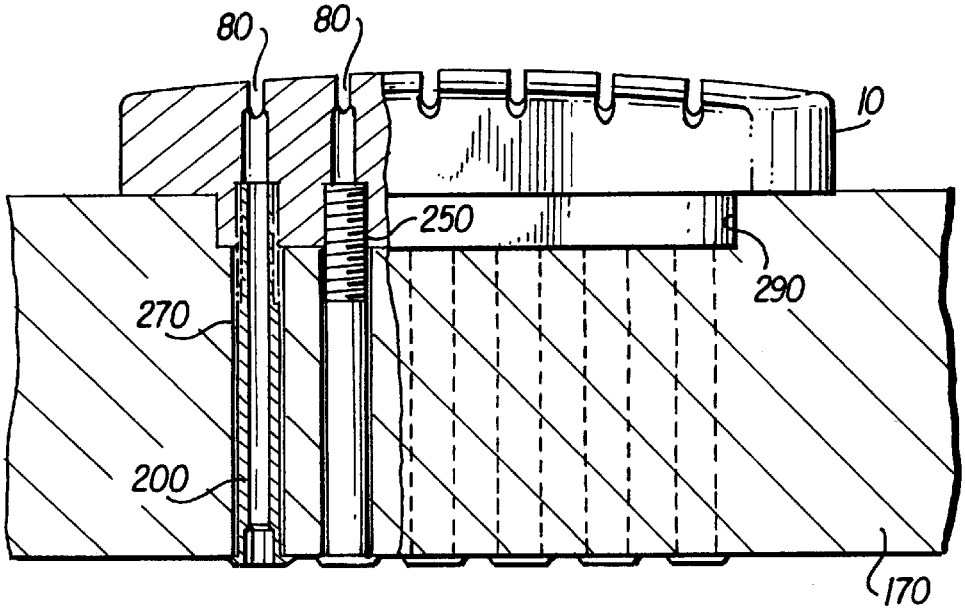
FIG. 8 is a partial broken-away rear elevational view of the bridge and screw.

As shown in FIG. 6, the top surface 70 also has an arched or curved shape 150 that extends from the front of the bridge 10 to the rear. The base portion 30 is also narrower than the main portion 40 providing an overhand portion over the base portion 30. This overhang that extends around the entire perimeter of the base portion 30 rests against the musical instrument 170 when the bridge 10 is set in place and attached to the musical instrument 170 as shown in FIG. 8.

Figure 4:
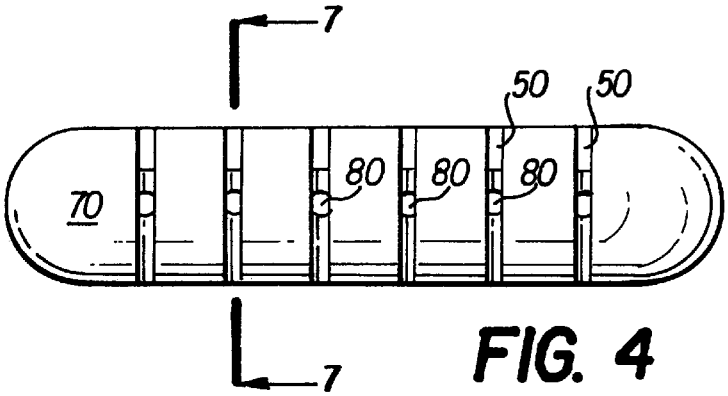
FIG. 4 is a top plan view thereof.
Figure 5:
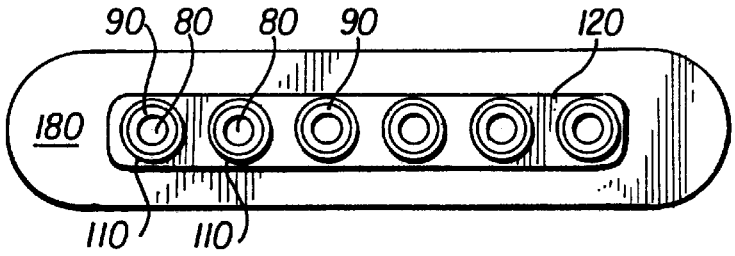
FIG. 5 is a bottom plan view thereof.

As shown in FIGS. 4 and 5, a plurality of slots 50 are formed in the top surface 70 of the main portion 40. The slots 50 extend from one side of the main portion 40 to the opposite side thereof. The slots 50 are equidistant and parallel to one another.

Located within each slot 50 is a hole 80 that extends completely through the depth of the bridge 10 from the inner portion of the slot 50 through to the bottom surface 180 of the base portion 30. Each slot 50 allows a string to be threaded through the bridge 10 when being connected to the instrument itself.

A channel 120 is formed in the bottom surface 180 of the base section 30. Each hole 80 opens to the channel 120 and is for accepting a coupling screw 200 (FIG. 9).

Figure 7:
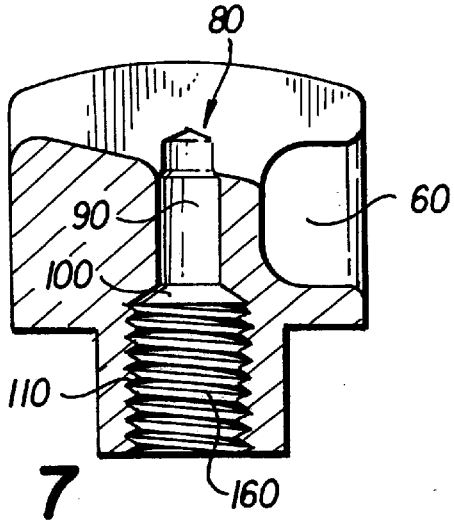
FIG. 7 is a cross-sectional view taken along line 7—7 in FIG. 4.

As shown in FIG. 7, each hole 80 has at least a first diameters 90, a second diameter 110 with a graduated portion 100 therebetween. The first diameter 90 is smaller than the second diameter 110 and the graduated portion 100 allows for the diameter of the hole 80 to gradually increase from the first diameter 90 to the second diameter 110.

The second diameter 110 is shown as being threaded 160 so as to provide a connection means with the coupling screw 200 which secures the bridge 10 to the musical instrument 170.

Figure 9:
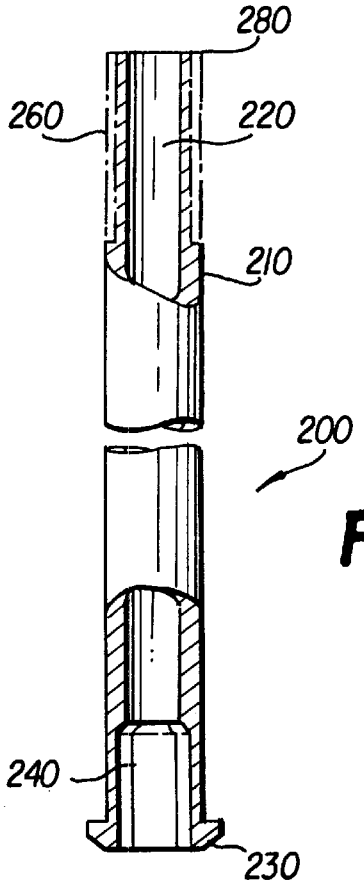
FIG. 9 is a broken-away side elevational view of the screw of the present invention.

The bridge 10 is connected to the musical instrument 170 with a plurality of coupling screws 200, as shown in FIGS. 8 and 9. Each coupling screw 200 is tubular in shape having an exterior wall 210 and a hollow interior 220 through which each string is strung. One end 240 of the coupling screw 200 has a slightly larger diameter than the remainder of the screw 200. The larger diameter area of the end 240 allows for a restraining means (not shown), that is attached to the end of a string, to nestle within the end 240 of the coupling screw 200 and form a retaining fit.

When the bridge 10 is attached to the musical instrument 170, the head 230 of the coupling screw 200 can be retained on the exterior of the musical instrument 170, as shown in FIG. 8, or the musical instrument 170 can be notched out so the head 230 is inset into the musical instrument 170.

The end 280 opposite the head 230 of the coupling screw 200 is threaded 260 so as to correspond with the threaded portion 250 of the bridge 10.

When the bridge 10 is attached to the musical instrument 170, the base portion 30 fits within a notch 290 formed in the musical instrument 170. A plurality of shafts 270 are also formed in the musical instrument 170 and have a slightly larger diameter than the exterior wall 210 of the coupling screw 200. Each coupling screw 200 is fit within a shaft 270 and screwed into the base portion 30 of the bridge 10 thus securing the bridge 10 to the musical instrument 170.

The first diameter 90 of the hole 80 is the same or similar to the diameter of the coupling screw 200. Therefore, when the threaded portion 260 of the coupling screw 200 is screwed into the threaded portion 250 of the second diameter 110 of the hole 80, the resulting inner diameter of both the bridge 10 and the coupling screw 200 is the same. This provides a smooth, consistent shaft through which the strings are threaded.

In use, with the strings (not shown) are threaded through the body of the musical instrument 170 through the coupling screws 200 and the holes 80. This arrangement provides for the bridge 10 being coupled to the musical instrument 170 with compression from the strings as well as compression from the coupling screws 200. The strings lay within the slots 50 and are attached to the neck of the musical instrument 170. When the strings are strummed or plucked, the strings vibrate causing the bridge 10 to vibrate. The resonance chamber 60 of the bridge 10 allows for improved resonance transfer from the strings to the body of the musical instrument.

Although the particular embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A bridge for securing strings to a musical instrument, comprising:

a body having a base and a main portion;

a plurality of slots formed in said main portion, said slots for receiving the strings;

a plurality of holes formed in said body and located within said plurality of slots, said holes for receiving the strings; and a resonance chamber formed in said main portion, wherein pressure is applied to said at least two sides of said bridge when in use on said musical instrument.

2. The bridge according to claim 1, further comprising:

a plurality of coupling screw for securing said bridge to the musical instrument, each of said plurality of coupling screws is threaded through the musical instrument and into a single one of said plurality of holes within said bridge;

wherein pressure is applied to a top of said bridge by the strings, and pressure is applied to a bottom of said bridge by said coupling screws thereby attaching said bridge through a dual compression system.

3. A bridge for attaching strings to a musical instrument, comprising:

a body;

a plurality of slots formed in said body;

a plurality of holes formed in said body;

a resonance chamber formed in said body, and a plurality of coupling screws for securing said body to the musical instrument, wherein strings may be threaded through said bridge and said plurality of coupling screws and wherein said plurality of coupling screws are attached to said bridge so that a force is applied to the bridge by the strings and another force is applied to the bridge by said plurality of coupling screws causing a dual compression system to be applied to said bridge to the musical instrument.

4. The bridge according to claim 3, wherein:

said body further comprises a base and a main portion.

5. The bridge according to claim 4, wherein:

said plurality of slots are formed in said main portion of said body.

6. The bridge according to claim 5, wherein:

said plurality of holes are located within said plurality of slots.

7. The bridge according to claim 6, wherein:

said resonance chamber is formed in said main portion of said body.

8. A bridge for securing strings to a musical instrument, comprising:

a body;

a plurality of slots formed in said body, said slots for receiving the strings;

an attachment means for attaching said bridge to the musical instrument; and a resonance chamber formed in said body, wherein pressure is applied to said at least two sides of said bridge when in use on said musical instrument.

9. The bridge according to claim 8, wherein:

said body further comprises a main portion and a base.

10. The bridge according to claim 9, wherein:

a plurality of slots are formed in said main portion of said body; and a plurality of holes formed in said plurality of slots, said holes for receiving the strings.

11. The bridge according to claim 10, wherein:

said attachment means is comprised of said plurality of holes and a plurality of mating coupling screws, wherein said coupling screws inserted through the musical instrument and screwed into a portion of said holes thereby attaching said bridge to the musical instrument.

* * * * *